US009919415B1

(12) United States Patent
Su

(10) Patent No.: US 9,919,415 B1
(45) Date of Patent: Mar. 20, 2018

(54) COMBINED TOOL STORAGE CONTAINER

(71) Applicant: Cheng-Wei Su, Taichung (TW)

(72) Inventor: Cheng-Wei Su, Taichung (TW)

( * ) Notice: Subject to any disclaimer, the term of this patent is extended or adjusted under 35 U.S.C. 154(b) by 0 days.

(21) Appl. No.: 15/272,477

(22) Filed: Sep. 22, 2016

(51) Int. Cl.
*B25H 3/00* (2006.01)

(52) U.S. Cl.
CPC ..... *B25H 3/003* (2013.01)

(58) Field of Classification Search
CPC .... A45C 5/00; A47F 7/00; B25H 3/00; B25H 3/003; B25H 3/02; B25H 3/023; B25H 3/04; B65D 85/00; B65D 85/28
USPC ..... 206/372, 373, 376–379; 211/70.6
See application file for complete search history.

(56) References Cited

U.S. PATENT DOCUMENTS 4,402,423 A * 9/1983 Skowronski ..... B65D 25/22 206/379
5,217,115 A * 6/1993 Purkapile ..... B25H 3/023 206/373
5,918,741 A * 7/1999 Vasudeva ..... B25H 3/003 206/372
6,213,296 B1 * 4/2001 Streich ..... A45C 5/00 206/373
6,405,864 B1 * 6/2002 Streich ..... A45C 5/00 206/373
6,868,967 B2 * 3/2005 Lam ..... A45C 13/02 206/372
7,584,845 B2 * 9/2009 Cheng ..... B25H 3/04 206/372
7,600,640 B2 * 10/2009 Hallee ..... B25H 3/003 206/373
8,950,597 B2 2/2015 Lin
9,193,062 B2 * 11/2015 Johnson ..... B25H 3/04
2010/0258465 A1 * 10/2010 Gomas ..... B25H 3/003 206/378
2015/0190921 A1 * 7/2015 Wang ..... B25H 3/023 206/372

* cited by examiner

*Primary Examiner* — Bryon Gehman
(74) *Attorney, Agent, or Firm* — Alan D. Kamrath; Kamrath IP Lawfirm, P.A.

(57) ABSTRACT

A combined tool storage container includes a first storage container and a locking device. The first storage container defines a first storage recess and includes a first clipping member. The first storage recess is adjacent to a first channel. The locking device is slidably connected to the first storage container and includes a first locking portion and a second locking portion. The first locking portion is inserted through the first channel. The first locking portion is movable between a locked position and a released position and selectively covers the first storage recess.

19 Claims, 9 Drawing Sheets

COMBINED TOOL STORAGE CONTAINER

BACKGROUND OF THE INVENTION

1. Field of the Invention

The present invention relates to a tool storage container and, particularly, to a combined tool storage containers.

2. Description of the Related Art

U.S. Pat. No. 8,950,597 shows a tool mount assembly. The tool mount assembly includes a mount, a first cover, and a second cover. The mount has multiple linear tool grooves. The first cover is pivotally connected with the mount and selectively covers the tool grooves. The second cover has multiple connecting grooves. The second cover is pivotally connected with the mount and selectively covers the connecting grooves. However, it is inconvenient for a user to store/take out a tool. Moreover, the first and second covers can pivot inadvertently and consequently inhibit a user from storing/taking out the tool.

The present invention is, therefore, intended to obviate or at least alleviate the problems encountered in the prior art.

SUMMARY OF THE INVENTION

According to the present invention, combined tool storage containers include a first storage container and a locking device. The first storage container has a first front side and a first back side opposite the first front side. The first front side defines a first storage recess and includes at least one first clipping member extending therefrom and adjacent to a side of the first storage recess. The at least one first clipping member is resilient and is adapted to resiliently releasably clip an object disposed in the first storage recess. The first storage recess is adjacent to a first channel. The first channel extends through the first front and first back sides. The locking device is slidably connected to the first storage container. The locking device includes a first locking portion inserted through the first channel. The first locking portion is movable between a locked position covering the first storage recess and a released position not covering the first storage recess.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide combined tool storage containers that allow a user to store/take out tools conveniently and without being obstructed.

It is another objective of the present invention that the combined tool storage containers have a simple structural design.

Other objectives, advantages, and new features of the present invention will become apparent from the following detailed description of the invention when considered in conjunction with the accompanied drawings.

DETAILED DESCRIPTION OF THE INVENTION

Figure 1:
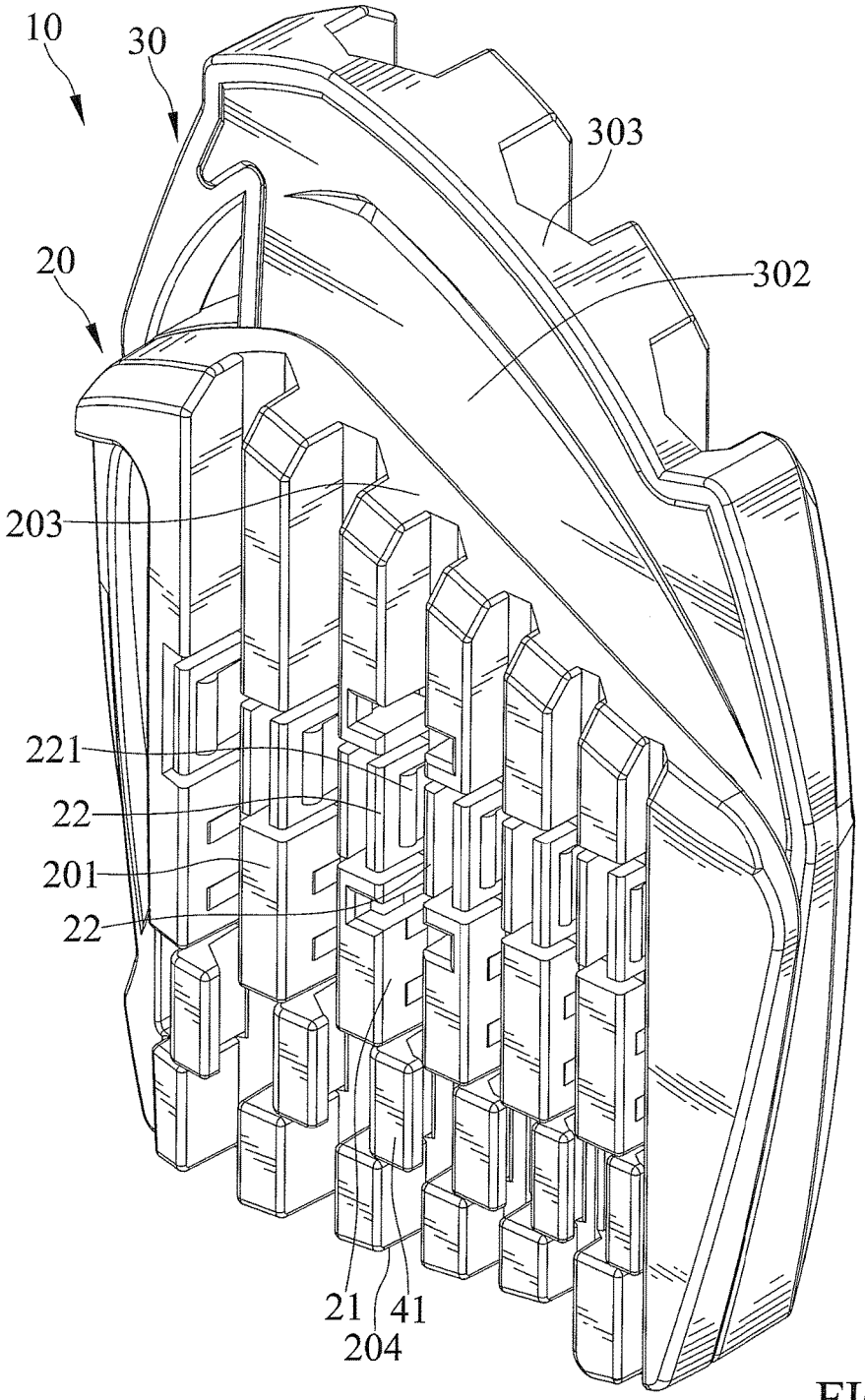
FIG. 1 is a perspective view of combined tool storage containers in accordance with the present invention.
Figure 2:
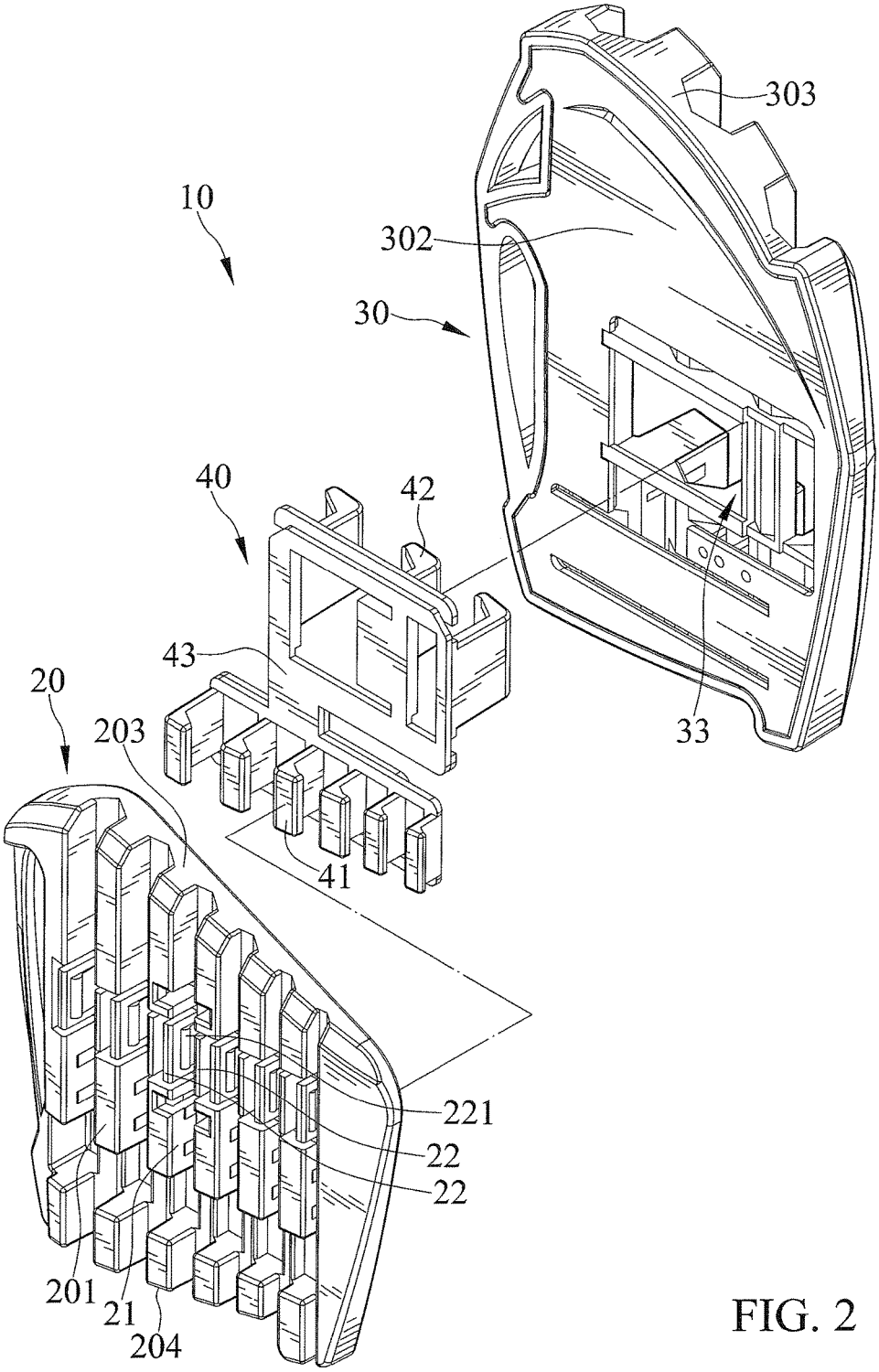
FIG. 2 is an exploded perspective view of the combined tool storage containers of the present invention.
Figure 3:
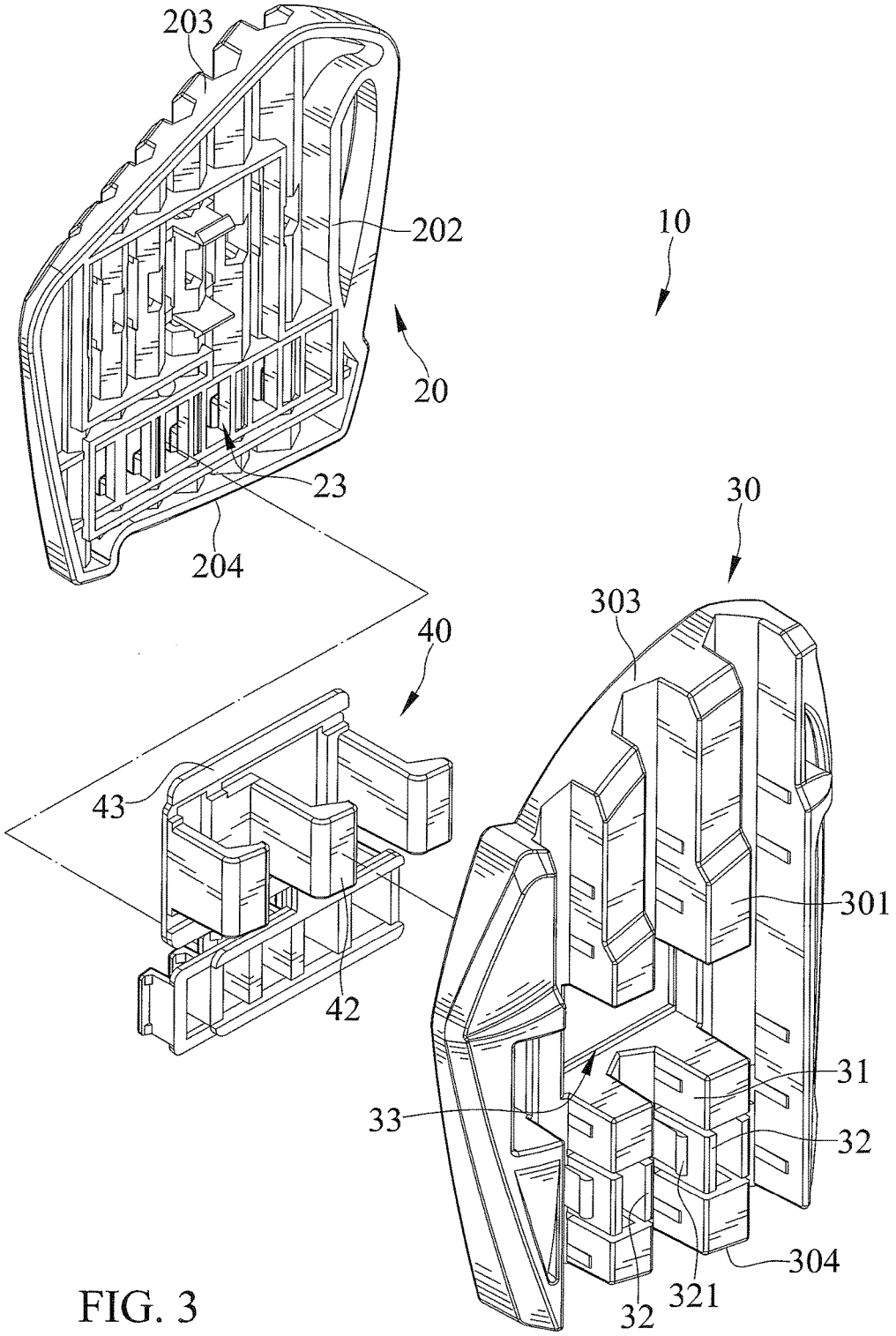
FIG. 3 is an exploded perspective view similar to FIG. 2, but shown from a different angle.
Figure 4:
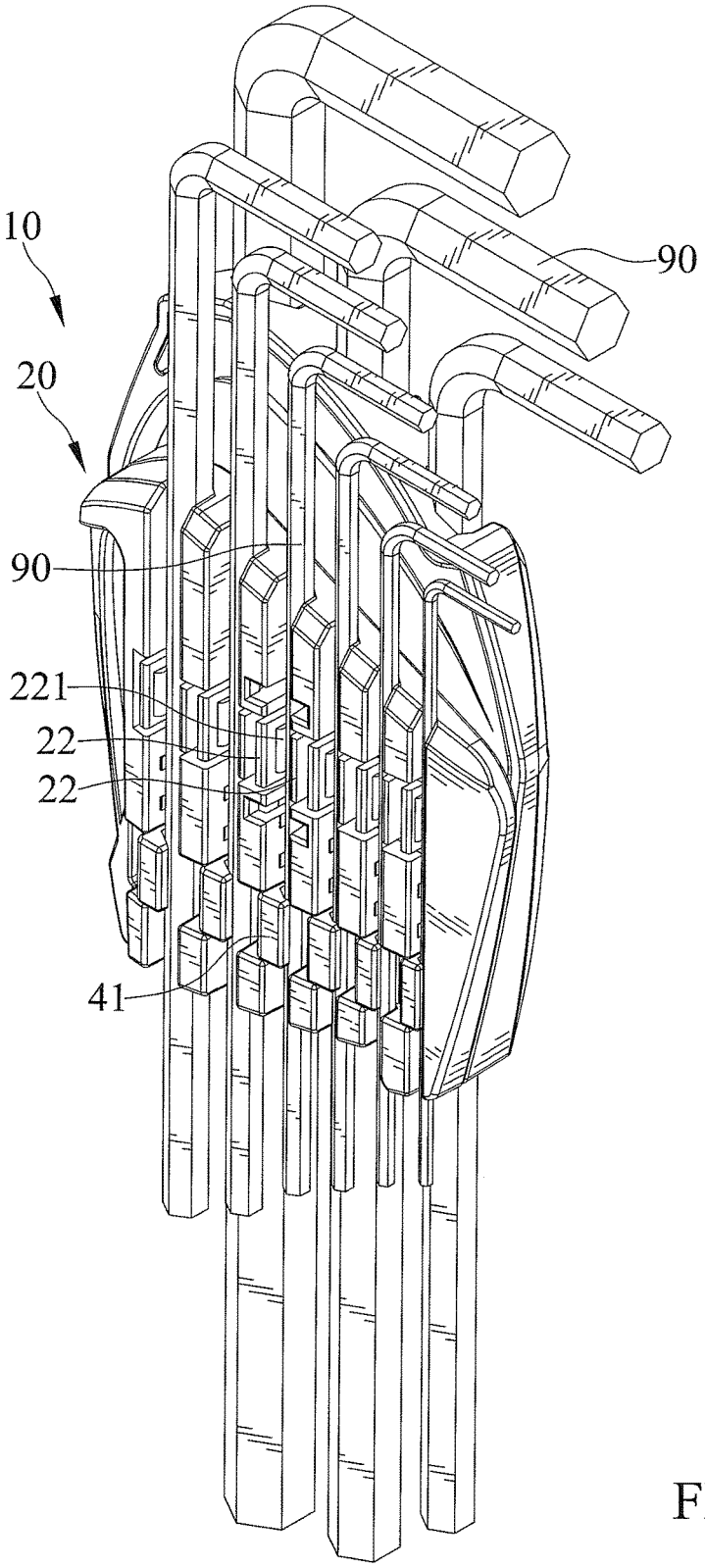
FIG. 4 is a perspective view illustrating the combined tool storage container tools stored in the combined tool storage containers.
Figure 5:
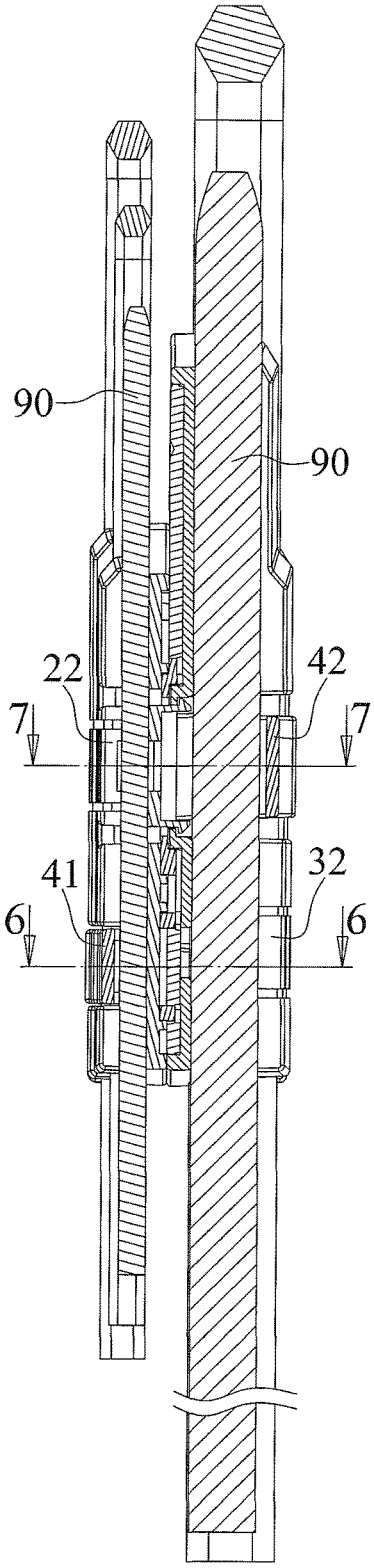
FIG. 5 is a cross-sectional view of FIG. 4 and illustrates tools stored in the combined tool storage containers, with the combined tool storage containers in a position restraining the tools and preventing them from being taken out.
Figure 6:
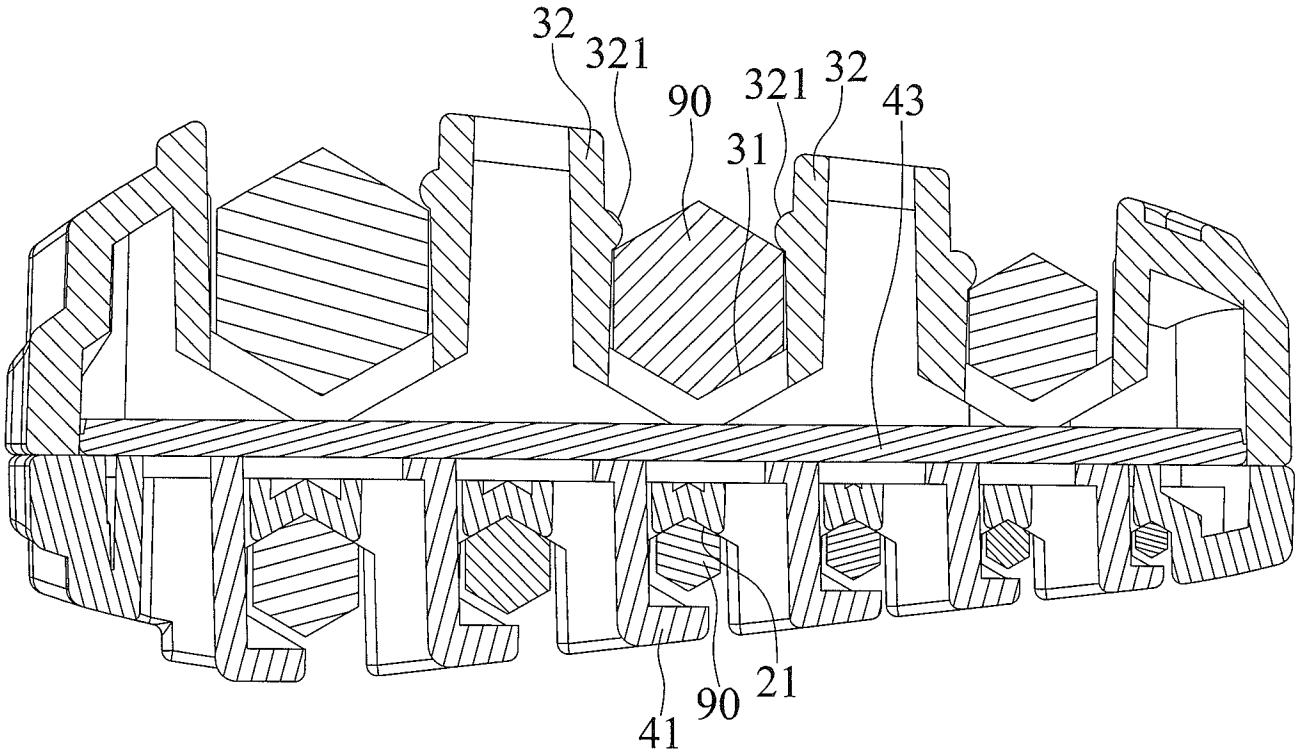
FIG. 6 is a cross-sectional view taken along line 6-6 of FIG. 5.
Figure 7:
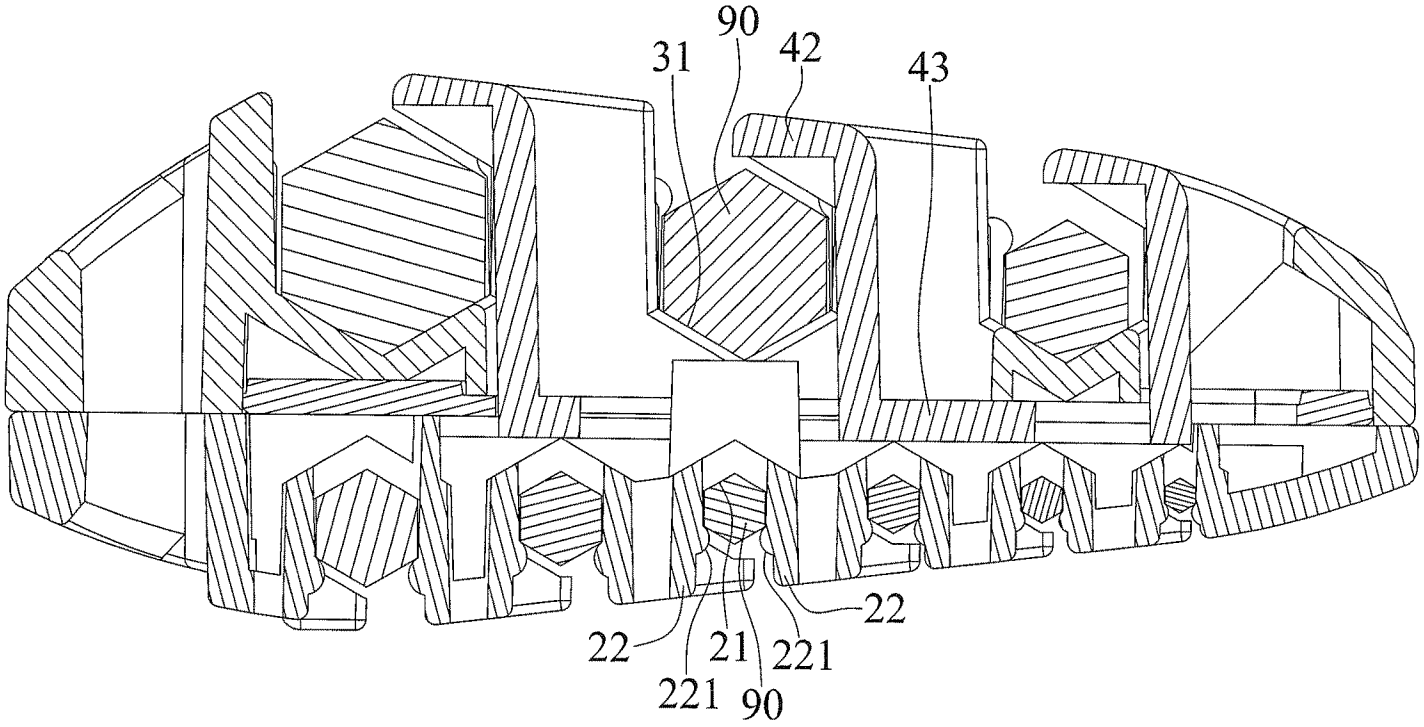
FIG. 7 is a cross-sectional view taken along line 7-7 of FIG. 5.
Figure 8:
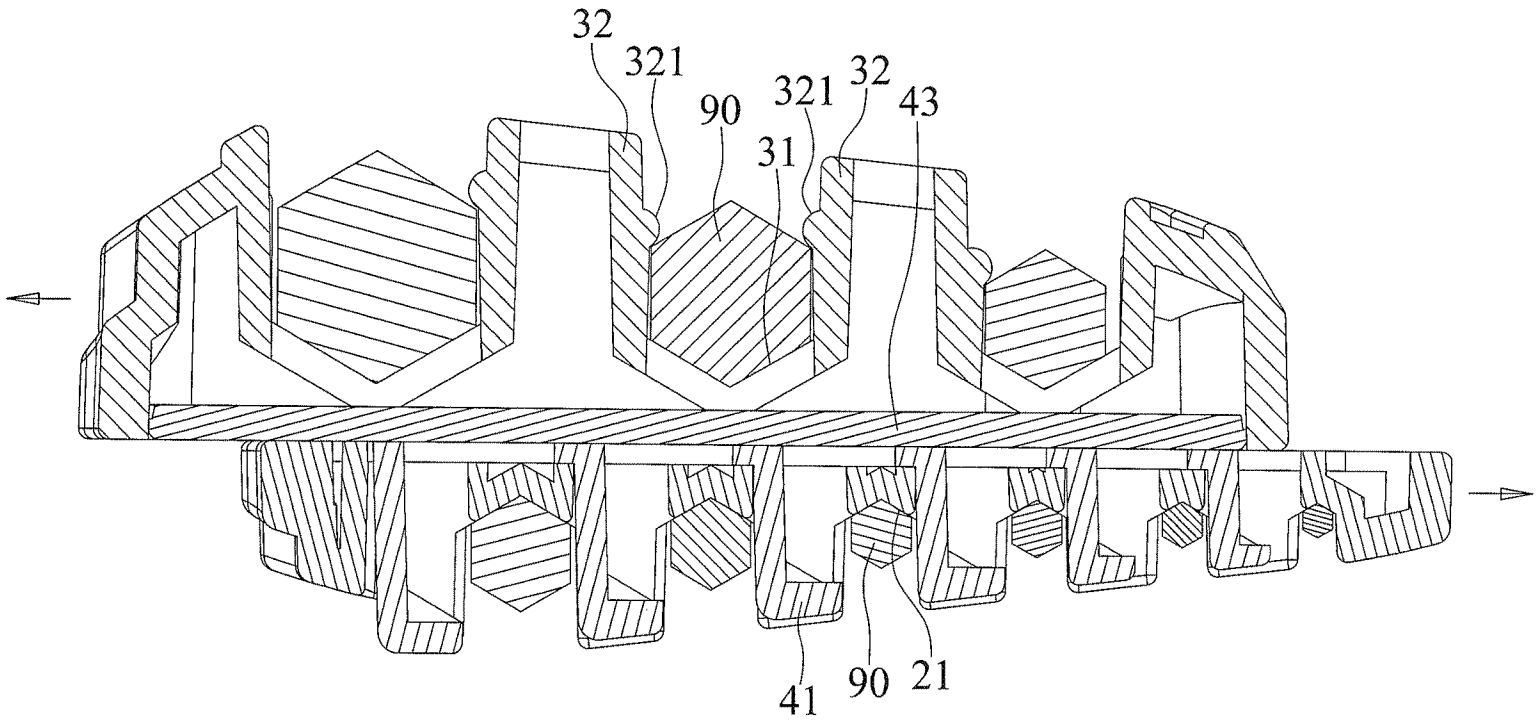
FIG. 8 is a cross-sectional view illustrating the combined tool storage containers in a position allowing the tools to be taken out.
Figure 9:
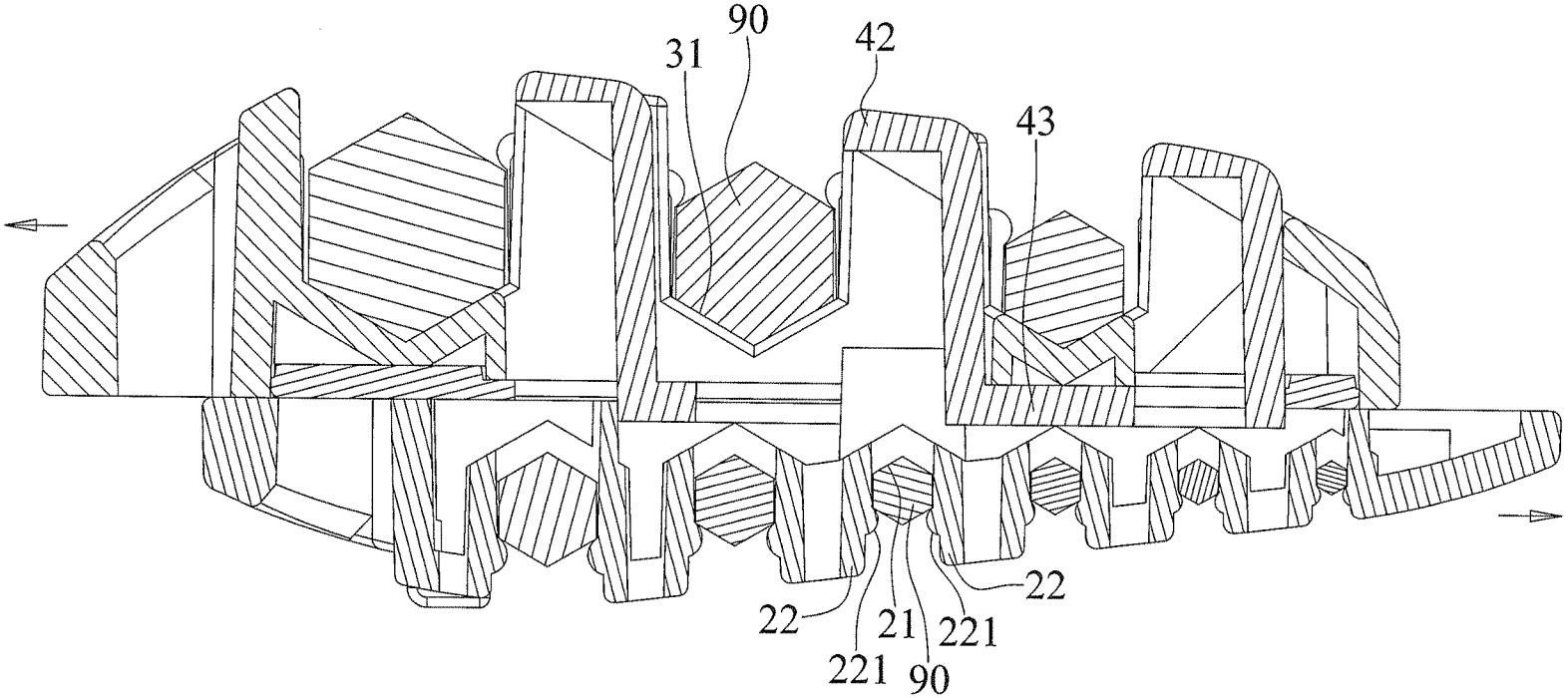
FIG. 9 is another cross-sectional view illustrating the combined tool storage containers in the position allowing the tools to be taken out.

FIGS. 1 through 9 show combined tool storage containers in accordance with the present invention.

A first storage container 20 has a first front side 201 and a first back side 202 opposite the first front side 201. The first storage container 20 has a first top side 203 and a first bottom side 204 opposite the first top side 203. The first top side 203 and the first bottom side 204 extend in a direction between the first front side 201 and the first back side 202. The first front side 201 defines a first storage recess 21. The first storage recess 21 extends longitudinally in a direction between the top side 203 and the bottom side 204. The first front side 201 includes at least one first clipping member 22 extending therefrom and adjacent to a side of the first storage recess 21. The at least one first clipping member 22 includes two first clipping members 22. The two first clipping members 22 are disposed on opposite sides of the first storage recess 21. The at least one first clipping member 22 is resilient and is adapted to resiliently releasably clip an object disposed in the first storage recess 21. The at least one first clipping member 22 includes a first end fixed to the first front side 201. The at least one first clipping member 22 includes a second end opposite the first end and being a free end. The at least one first clipping member 22 has an extended body portion between the first and second ends. The extended body portion of the first clipping members 22 is aligned with an adjacent lateral side of the first storage recess 21. The at least one first clipping member 22 includes a first protrusion 221 adapted to releasably restrain the object. The first protrusion 221 is located above a bottom side of the first storage recess 21. The first protrusion 221 extends transversely to the extended body portion of the at least one first clipping member 22. The at least one first clipping member 22 is resiliently movable between a first position in which the first protrusion 221 protrudes into the first storage recess 21 and a second position in which the first protrusion 221 does not protrude into the first storage recess 21. The first storage recess 21 is adjacent to a first channel 23. The first channel 23 extends through the first front and first back sides 201 and 202.

A second storage container 30 is adapted to be coupled to the first storage container 20. The second storage container 30 has a second front side 301 and a second back side 302 opposite the second front side 301. The second storage container 30 has a second top side 303 and a second bottom side 304 opposite the second top side 303. The second top side 303 and the second bottom side 304 extend in a direction between the second front side 301 and the second back side 302. The second front side 301 defines a second storage recess 31. The second storage recess 31 extends longitudinally in a direction between the top side 203 and the bottom side 204. The second front side 301 includes at least one second clipping member 32 extending therefrom and adjacent to a side of the second storage recess 31. The at least one second clipping member 32 includes two second clipping members 32. The two second clipping members 32 are disposed on opposite sides of the second storage recess 31. The at least one second clipping member 32 is resilient and is adapted to resiliently releasably clip an object disposed in the second storage recess 31. The at least one second clipping member 32 includes a first end fixed to the second front side 301 and a second end opposite the first end and being a free end. The second clipping member 32 has an extended body portion between the first and second ends. The extended body portion of the second clipping member 32 is respectively aligned with an adjacent lateral side of the second storage recess 31. The second protrusion extends transversely to the extended body portion of the at least one second clipping member 32. The at least one second clipping member 32 includes a second protrusion 321 adapted to releasably restrain the object. The second protrusion 321 is located above a bottom side of the second storage recess 31. The at least one second clipping member 32 is resiliently movable between a first position in which the second protrusion 321 protrudes into the second storage recess 31 and a second position in which the second protrusion 321 does not protrude into the second storage recess 31. The second storage recess 31 is adjacent to a second channel 33. The second channel 33 extends through the second front and second back sides 301 and 302.

The first and second storage recesses 21 and 31 respectively define first and second openings. The first and second openings respectively provide access to the first and second storage recesses 21 and 31. The first and second storage recesses 21 and 31 are adapted to receive objects. The objects are tools. FIGS. 4-9 show the tools are hex wrenches 90.

A locking device 40 is slidably connected to the first and second storage containers 20 and 30. The locking device 40 includes the first and second storage containers 20 and 30 disposed oppositely. The locking device 40 includes a first locking portion 41 and a second locking portion 42 respectively inserted through the first channel 23 and the second channel 33. The first locking portion 41 is movable between a locked position covering the first storage recess 21 and a released position not covering the first storage recess 21. The second locking portion 42 is movable between a locked position covering the second storage recess 31 and a second position not covering the second storage recess 31. The first locking portion 41 includes a first end fixed to a first body of the locking device 40 and a second end opposite the first end and being a free end. The second locking portion 42 includes a first end fixed to a second body of the locking device 40 and a second end opposite the first end and being a free end. The second end of the first locking portion 41 has a greater width than the first end of the first locking portion 41. The second end of the second locking portion 42 has a greater width than the first end of the second locking portion 42. The locking device 40 includes a connecting portion 43 between the first and second locking portions 41 and 42. The connecting portion 43 has a first side and a second side opposite the first side. The first and second sides of the connecting portion 43 are respectively releasably connected to the first back side 202 of the first storage container 20 and the second back side 302 of the second storage container 30.

The hex wrenches 90 received in the first and second storage recess 21 and 31 are prevented from being taken out when the first and second storage recesses 21 and 31 are respectively covered by the first and second locking position 41 and 42 and when the first and second locking portions 41 and 42 are moved to the locked positions thereof. Furthermore, the first and second storage recesses 21 and 31 are respectively covered by the second end of the first locking portion 41 and the second end of the second locking portion 42.

The hex wrench 90 received in the first and second storage recess 21 and 31 can be taken out when the first and second locking portions 41 and 42 the first and second storage recesses 21 and 31 are not respectively covered by the first and second locking portions 41 and 42 and when the first and second locking portions 41 and 42 are moved to the released positions thereof. Furthermore, the first and second storage recesses 21 and 31 are not respectively covered by the second end of the first locking portion 41 and the second end of the second locking portion 42.

In view of the forgoing, the combined tool storage containers 10 allow a user to store/take out tools conveniently and without being obstructed. Furthermore, the combined tool storage containers 10 have a simple structural design.

The foregoing is merely illustrative of the principles of this invention and various modifications can be made by those skilled in the art without departing from the scope and spirit of the invention.

What is claimed is:

1. A combined tool storage container comprising:

a first storage container having a first front side and a first back side opposite the first front side, with the first front side defining a first storage recess and including at least one first clipping member extending from and adjacent to a side of the first storage recess, with the at least one first clipping member being resilient and adapted to resiliently releasably clip an object disposed in the first storage recess, with the first storage recess adjacent to a first channel, and with the first channel extending through the first front and first back sides; and a locking device slidably connected to the first storage container, wherein the locking device includes a first locking portion inserted through the first channel, wherein the first locking portion is movable between a locked position covering the first storage recess and a released position not covering the first storage recess.

2. The combined tool storage container as claimed in claim 1, further comprising a second storage container coupled to the first storage container, with the second storage container having a second front side and a second back side opposite the second front side, and with the second front side defining a second storage recess.

3. The combined tool storage container as claimed in claim 2, wherein the second storage recess is adjacent to a second channel, wherein the second channel extending through the second front and second back sides, wherein the locking device is slidably connected to the second storage container, and wherein the locking device includes a second locking portion inserted through the second channel, and wherein the second locking portion is movable between a locked position covering the second storage recess and a second position not covering the second storage recess.

4. The combined tool storage container as claimed in claim 3, wherein the locking device includes a connecting portion between the first and second locking portions, wherein the connecting portion has a first side and a second side opposite the first side, and wherein the first and second sides of the connecting portion are respectively releasably connected to the first back side of the first storage container and the second back side of the second storage container.

5. The combined tool storage container as claimed in claim 3, wherein the first locking portion includes a first end fixed to a first body of the locking device and a second end opposite the first end and being a free end, wherein the first storage recess is covered by the second end of the first locking portion when the first locking portion is moved to the locked position thereof, wherein the second lock locking portion includes a first end fixed to a second body of the locking device and a second end opposite the first end and being a free end, and wherein the second storage recess is covered by the second end of the second locking portion when the second locking portion is moved to the locked position thereof.

6. The combined tool storage container as claimed in claim 5, wherein the second end of the first locking portion has a greater width than the first end of the first locking portion, and wherein the second end of the second locking portion has a greater width than the first end of the second locking portion.

7. The combined tool storage container as claimed in claim 3, wherein the first and second storage containers are disposed oppositely and include the locking device disposed therebetween.

8. The combined tool storage container as claimed in claim 7, wherein the second front side of the second storage container includes at least one second clipping member extending from and adjacent to a side of the second storage recess, and wherein the at least one second clipping member is resilient and is adapted to resiliently releasably clip an object disposed in the second storage recess.

9. The combined tool storage container as claimed in claim 2, wherein the second front side of the second storage container includes at least one second clipping member extending from and adjacent to a side of the second storage recess, and wherein the at least one second clipping member is resilient and is adapted to resiliently releasably clip an object disposed in the second storage recess.

10. The combined tool storage container as claimed in claim 9, wherein the at least one first clipping member includes a first protrusion adapted to releasably restrain the object, wherein the first protrusion is located above a bottom side of the first storage recess, wherein the at least one first clipping member is resiliently movable between a first position in which the first protrusion protrudes into the first storage recess and a second position in which the first protrusion does not protrude into the first storage recess.

11. The combined tool storage container as claimed in claim 10, wherein the at least one first clipping member includes a first end fixed to the first front side and a second end opposite the first end and being a free end, wherein the at least one first clipping member has an extended body portion between the first and second ends, wherein the extended body portion of the first clipping members is aligned with an adjacent lateral side of the first storage recess, and wherein the first protrusion extends transversely to the extended body portion of the at least one first clipping member.

12. The combined tool storage container as claimed in claim 11, wherein the at least one second clipping member includes a second protrusion adapted to releasably restrain the object, wherein the second protrusion is located above a bottom side of the second storage recess, and wherein the at least one second clipping member is resiliently movable between a first position in which the second protrusion protrudes into the second storage recess and a second position in which the second protrusion does not protrude into the second storage recess.

13. The combined tool storage container as claimed in claim 12, wherein the at least one second clipping member includes a first end fixed to the second front side and a second end opposite the first end and being a free end, wherein the second clipping member has an extended body portion between the first and second ends, wherein the extended body portion of the second clipping member is respectively aligned with an adjacent lateral side of the second storage recess, and wherein the second protrusion extends transversely to the extended body portion of the at least one second clipping member.

14. The combined tool storage container as claimed in claim 10, wherein the at least one second clipping member includes a second protrusion adapted to releasably restrain the object, wherein the second protrusion is located above a bottom side of the second storage recess, and wherein the at least one second clipping member is resiliently movable between a first position in which the second protrusion protrudes into the second storage recess and a second position in which the second protrusion does not protrude into the second storage recess.

15. The combined tool storage container as claimed in claim 9, wherein the at least one first clipping member includes two first clipping members, wherein the two first clipping members are disposed on opposite sides of the first storage recess, wherein the at least one second clipping member includes two second clipping members, and wherein the two second clipping members are disposed on opposite sides of the second storage recess.

16. The combined tool storage container as claimed in claim 1, wherein the first storage container has a first top side and a first bottom side opposite the first top side, wherein the first top side and the first bottom side extend in a direction between the first front side and the first back side, and wherein the first storage recess extends longitudinally in a direction between the first top side and the first bottom side.

17. The combined tool storage container as claimed in claim 1, wherein the at least one first clipping member includes a first protrusion adapted to releasably restrain the object, wherein the first protrusion is located above a bottom side of the first storage recess, wherein the at least one first clipping member is resiliently movable between a first position in which the first protrusion protrudes into the first storage recess and a second position in which the first protrusion does not protrude into the first storage recess.

18. The combined tool storage container as claimed in claim 17, wherein the at least one first clipping member includes a first end fixed to the first front side, wherein the at least one first clipping member includes a second end opposite the first end and being a free end, wherein the at least one first clipping member has an extended body portion between the first and second ends, wherein the extended body portion of the first clipping members is aligned with an adjacent lateral side of the first storage recess, and wherein the first protrusion extends transversely to the extended body portion of the at least one first clipping member.

19. The combined tool storage container as claimed in claim 1, wherein the at least one first clipping member includes two first clipping members.

* * * * *